United States Patent [19]

Andersson et al.

[11] Patent Number: 4,513,579

[45] Date of Patent: Apr. 30, 1985

[54] METHOD AND ARRANGEMENT FOR MAINTAINING A FROST-FREE FREEZER

[75] Inventors: Karl F. Andersson, Åkersberga; Bolik A. G. Eriksson, Johanneshov, both of Sweden

[73] Assignee: Aktiebolaget Electrolux, Stockholm, Sweden

[21] Appl. No.: 503,154

[22] PCT Filed: Sep. 16, 1982

[86] PCT No.: PCT/SE82/00284

§ 371 Date: May 16, 1983

§ 102(e) Date: May 16, 1983

[87] PCT Pub. No.: WO83/01293

PCT Pub. Date: Apr. 14, 1983

[30] Foreign Application Priority Data

Sep. 29, 1981 [SE] Sweden ..... 8105757

[51] Int. Cl.[3] ..... F25D 17/04

[52] U.S. Cl. ..... 62/176.2; 62/80; 62/94; 55/387

[58] Field of Search ..... 62/94, 271, 80, 81, 62/176 A; 55/387, 390

[56] References Cited

U.S. PATENT DOCUMENTS 2,946,201 7/1960 Munters ..... 62/94 X 4,180,985 1/1980 Northrup ..... 62/94

*Primary Examiner*—Henry Bennett

*Attorney, Agent, or Firm*—Alfred E. Miller

[57] ABSTRACT

In a freezer with a chamber, in which refrigerated surfaces tend to collect frost, with a moisture absorbing regenerable filter in order to lower the relative humidity of the freezing chamber air and counteract forming of frost therein, the filter has had to be removed and regenerated outside the freezer. This can be avoided if the air of the freezing chamber is conducted through a first flow path having a motor driven fan and a filter and ambient air is conducted through the fan and the filter in a second flow path for regeneration of the filter. An arrangement for the purpose is characterized in that the filter is arranged in a first heat-insulated flow path, intended for freezing chamber air and containing a motor driven fan, that a second heat-insulated flow path, intended for ambient air, is connected to the first one before and after a part thereof containing the filter and the fan, and that valves are arranged for shifting of the flow paths.

8 Claims, 2 Drawing Figures

METHOD AND ARRANGEMENT FOR MAINTAINING A FROST-FREE FREEZER

This invention relates to a method in a freezer with a chamber, in which refrigerated surfaces tend to collect frost, and with a moisture adsorbing regenerable filter in order to lower the relative humidity of the freezing chamber air and counteract forming of frost therein. The invention also relates to an arrangement for the purpose.

It is known that the relative humidity of the chamber air in a freezer varies with the temperature variations in the chamber. If it is possible to lower the relative humidity of the air below the normal level, present when the freezer operates without any influence from outside on the humidity, the frost formed on the freezing system or on the coldest surfaces of the freezing chamber will by sublimation be transferred from solid body direct to vapour. This principle has been the foundation for a proposal to arrange in a freezer a separate freezing chamber air flow path having a moisture adsorbing filter and a motor driven fan. This proposal further comprises a removable filter, for instance in the shape of a shelf for goods in the cabinet. The filter can be regenerated, for instance by heat treatment in an oven. This proposal has been presented in EPO-application No. 80850170.4 published under No. 31,311.

Since certain difficulties are involved in performing the regeneration of the filter in the freezing cabinet proposed above, the arrangement for moisture adsorption is so made that the freezer cabinet can operate during long periods without regeneration of the filter. In that case the filter will be relatively bulky and expensive. In spite thereof it is required that the person handling the cabinet is alert and regenerates the filter before it has become saturated and no longer is capable of keeping the refrigerated surfaces of the freezing chamber free of frost.

The object of the invention is to remove the said drawbacks and to provide a method and an arrangement making it possible for a freezer to operate automatically without collection of frost in the freezing chamber, without any special supervision being necessary and without special precautions for regeneration of the filter being necessary. An arrangement according to the invention for this purpose is mainly characterized in that the filter is arranged in a first heat-insulated flow path, intended for freezing chamber air and containing a motor driven fan, that a second heat-insulated flow path, intended for ambient air, is connected to the first one before and after a part thereof containing the filter and the fan, and that valves are arranged for shifting of the flow paths. The method according to the invention is mainly characterized in that the freezing chamber air is conducted through a first flow path having a motor driven fan and a filter and that ambient air is conducted through the fan and the filter in a second flow path for regeneration of the filter.

Figure 1:
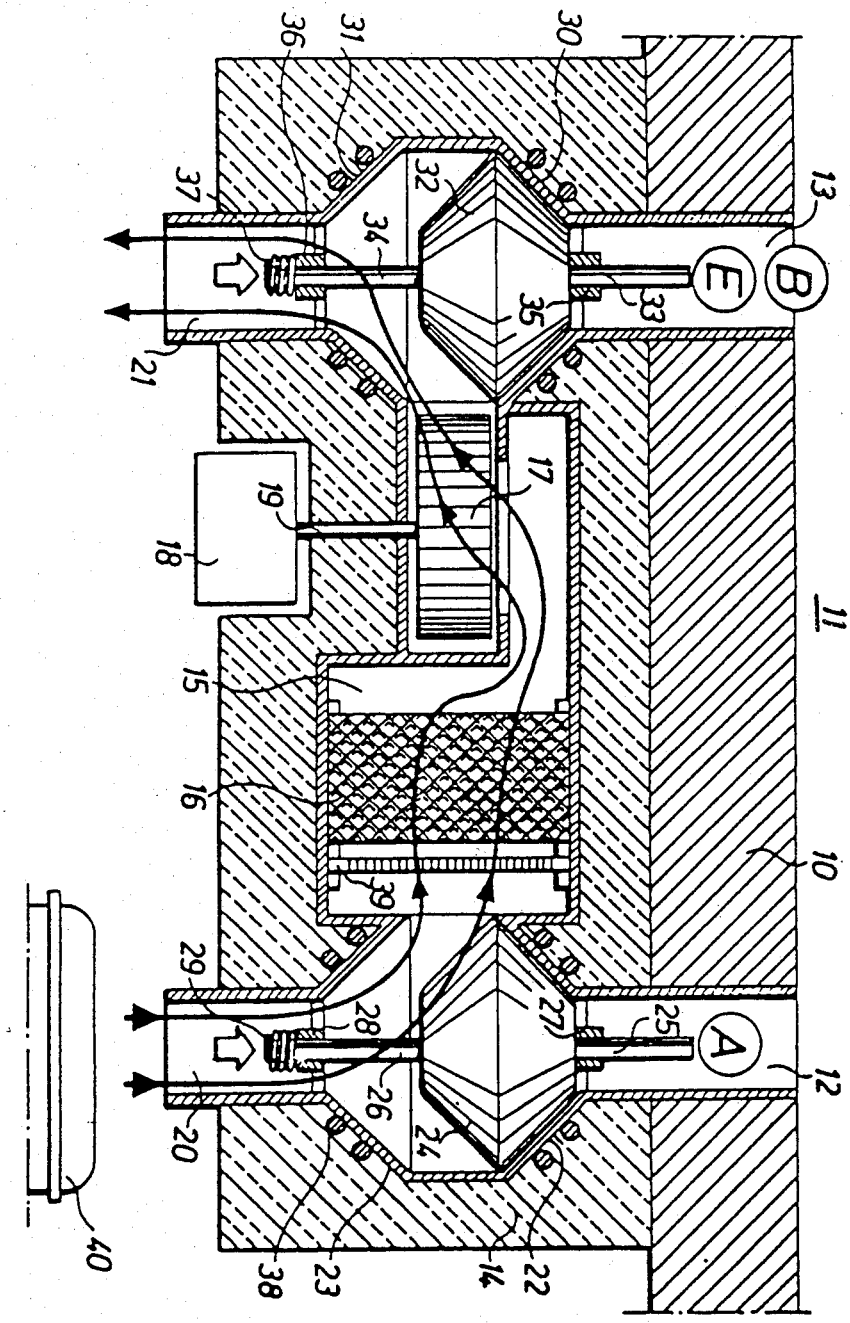
Figure 2:
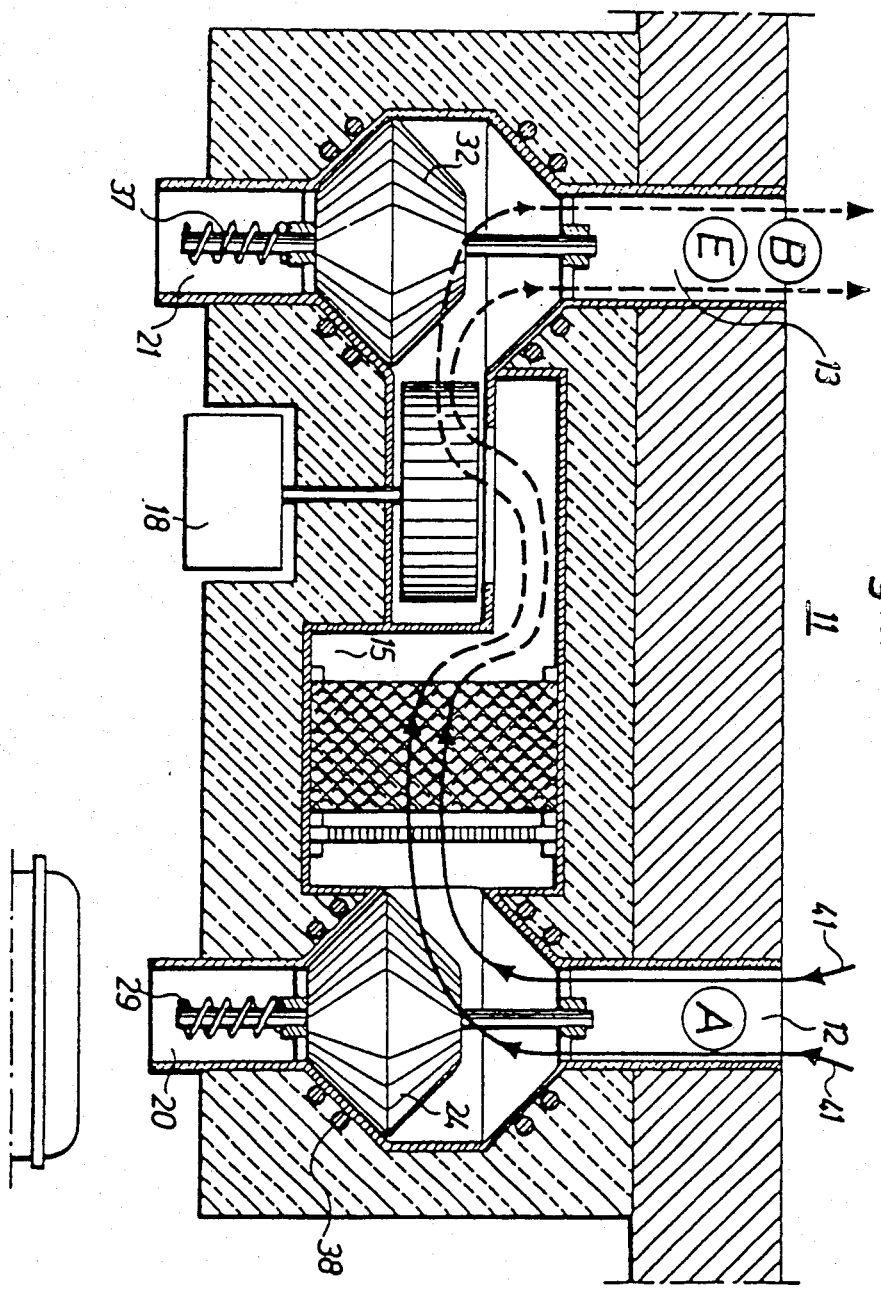

In the following the invention will be described more in detail by way of example with reference to an embodiment shown in the drawings in which FIGS. 1 and 2 show an arrangement for defrosting a freezing chamber with the valves of the arrangement in different positions for keeping a freezing chamber frostfree.

In a freezer cabinet having a bottom step under which the compressor of the cabinet is arranged it is suitable to locate the arrangement according to the invention at the side of the compressor below the said bottom step. If the freezer is of some other design the arrangement may be placed at another suitable location. The Figures show a vertical section through a bottom step 10 under a freezing chamber 11. Through the bottom step 10 goes an inlet conduit 12 for air to a space 15 and an outlet conduit 13 for air from the space. The space 15 is surrounded by a heat insulation 14 and contains a regenerable filter 16 and a fan 17 driven by a motor 18 having a shaft 19 to the fan. To the space 15 goes an inlet conduit 20 for ambient air and from the space goes an outlet conduit 21 for the air. Between the two inlet conduits 12 and 20 there are valve seats 22, 23 having a valve body 24 arranged to keep one of the flow paths open and the other closed. The valve body 24 has on each side a shaft 25, 26 guided in bearings 27, 28. Between the bearing 28 and the free end of the shaft 26 is a tension spring 29 tending to keep the valve body 24 in the position shown in FIG. 1 with the inlet conduit 12 for chamber air closed.

Between the two outlet conduits 13 and 21 valve seats 30, 31 are arranged in a corresponding way with a valve body 32. On each side this body 32 has a guiding spindle 33, 34 guided in bearings 35, 36. Between the bearing 36 on the outlet conduit 21 and the free end of the spindle 34 a tension spring 37 is arranged tending to keep the valve body 32 in the position shown in FIG. 1 with the outlet conduit 13 to the freezing chamber 11 closed. In the Figures it is also indicated that the valve seats 22, 23, 30, 31 have a heating arrangement, for instance an electric heating coil 38. In the chamber 15, before the filter 16 as seen in the flow direction of the air, a heater 39 is arranged which can be a net-shaped element, for instance of semi-conductor type such as a PTC-element. Thereby the air ahead of the filter can be heated to a certain temperature, for instance 100° C. Further a compressor 40 is indicated whose heat dissipation to the ambient can be used.

In the inlet conduit from the freezing chamber 11 is a sensor A which reacts to the relative humidity in the air, and in the outlet conduit 13 to the freezing chamber 11 there is a corresponding sensor B reacting to the relative humidity of the air at this location. Further in the conduit 13 there is a temperature sensor E forming an overheating protection.

The arrangement shown operates in the following manner.

The freezer is in operation with a compressor 40 in a refrigeration system of a type known per se and keeps a prescribed temperature in the freezing chamber 11. The sensor A reacts to the relative humidity in the freezing chamber 11 and when it exceeds a predetermined value, say 60%, a control arrangement, not shown, is influenced which activates electromagnets, not shown, which move the valve bodies 24 and 32 from the position shown in FIG. 1 to that shown in FIG. 2, in which a first flow path intended for freezing chamber air is opened through the inlet conduit 12, the space 15 and the outlet conduit 13. At the same time a second flow path through the inlet conduit 20 for ambient air, the space 15 and the outlet conduit 21 is closed. The fan motor 18 is started and freezing chamber air passes through the first flow path 12, 15, 13, as indicated by arrows 41. The relative humidity of the freezing chamber air then decreases and when it has reached below the predetermined value the control arrangement reacts so that the said electromagnets are inactivated and the tension springs 29 and 37 shift the valves from the position of FIG. 2 to the position of FIG. 1, in which the first flow path is closed whereas the second one is open.

Such shifting of the valve bodies can occur several times but after some time the sensor B in the outlet conduit 13 to the freezing chamber 11 reacts when the filter is saturated and the relative humidity of the ar flowing into the chamber exceeds a certain value, for instance 75%. Then the control arrangement is influenced and will no longer keep the valve bodies 24 and 32 in the position of FIG. 2 but releases them so that the first flow path 12, 15, 13 is kept closed and the second flow path intended for ambient air is kept open. Simultaneously energy is supplied to the heating element 39 and the fan motor 18 is activated. Now heated air is sucked through the filter 16 by the fan 17 and the humidity collected in the filter is transferred to the ambient. If heat from the compressor 40 is used, preheated air at abt. 70° C. is obtained and a very low effect is required for the heating element 39. It is possible in the control arrangement to include means depending on whether the compressor is operating or not so that regeneration is not started until the compressor is active.

In the foregoing, an embodiment of the invention has been described in which regeneration is performed depending on the actual need. Such a control can be replaced by or combined with another one which is more or less time-controlled.

When regeneration is finished the fan 17 is stopped and the element 39 is disconnected. The temperature in the space 15 is however considerably higher than the temperature in the freezing chamber 11. Therefore it is desirable to lower this temperature which can be achieved by natural draft. It is however possible instead to arrange the control means in such a way that the valve body 24 is shifted and keeps the inlet conduit 12 open and the inlet conduit 20 from the ambient closed. If then the fan 17 is operated a certain quantity of cold freezing chamber air is sucked through the heating element 39, the filter 16 and the space 15 so that it is rapidly cooled. Thereafter the valve body 24 is returned to the position of FIG. 1.

It is suitable to dimension the arrangement so that the filter will adsorb 20–30 grams of water per 24 hours, which means that a regeneration is needed every 24 hours. The filter itself will have small size and also other components of the arrangement can be kept within limits, which very much reduces the space required and also causes low cost of the unit. For the control of the water transport from the freezing chamber it is suitable to use an electronic control system with a microprocessor. If instead another control system is chosen and time-control is used for the regeneration, the system will not be energy optimated but has to be dimensioned according to the most difficult case which can be expected with respect to the quantities of humidity in the freezing chamber 11.

We claim:

1. An arrangement in a freezer having a chamber in which refrigerated surfaces collect frost comprising: a duct, a moisture-absorbing regenerable filter mounted in said duct, a fan in said duct, said fan being arranged to circulate freezing chamber air through said filter in order to lower the humidity of the freezing chamber air and to counteract frost forming therein, a plurality of communication channels beetween said freezing chamber and said duct and between said duct and ambient air, and valve means arranged to open and close selected communication channels forming a first flow path between said freezing chamber and said duct, and to selectively bring said duct into communication with ambient air through other of said communication channels forming a second flow path, said fan being arranged to circulate said ambient air through the duct and thereby through the filter, and means for heating said filter to regenerate it when said ambient air is circulating through said filter, said heating means being arranged ahead of said valve means in said second flow path.

2. Arrangement according to claim 1 wherein said heating means comprises a heating element which is arranged in the duct.

3. Arrangement according to claim 1 wherein the valve means comprise one valve body located at one end of the duct and one valve body located at the other end of the duct, the valve bodies being arranged so that when they take a first position they allow the freezing chamber air to circulate through the duct and prevent the ambient air from circulating through the duct, and when they take a second position they allow the ambient air to circulate through the duct and prevent the freezing chamber air from circulating through the duct.

4. Arrangement according to claim 1 further comprising a valve chamber and wherein each valve body is enclosed in said valve chamber in which the valve body is rectilinearly movable between two oppositely located valve seats, the valve taking the first position when it rests aginst one of the valve seats and taking the second position when it rests against the other valve seat.

5. Arrangement according to claim 1 further comprising a first sensor sensing the humidity of the air of the freezing chamber, a second sensor sensing the humidity of the freezing chamber air leaving the filter, and a device for controlling said fan, the sensors being connected to said device which also controls means operating the valve means and the means for supplying heat to the filter.

6. Arrangement as claimed in claim 1 wherein the duct with the filter and the fan and the valve means are arranged outside a wall of the freezing chamber.

7. An arrangement according to claim 3 further comprising springs for said valve means and wherein the valves are tensioned by said springs in order to maintain the first flow path closed and that they are provided with control means by which the valve bodies keep the second flow path closed against the action of springs.

8. An arrangement according to claim 3 wherein the movable valve bodies in the valves are made of heat-insulating material.

* * * * *